US007281823B2

(12) United States Patent
Moisel

(10) Patent No.: US 7,281,823 B2
(45) Date of Patent: Oct. 16, 2007

(54) HEADLIGHT FOR A VEHICLE

(75) Inventor: Joerg Moisel, Neu-Ulm (DE)

(73) Assignee: DaimlerChrysler AG, Stuttgart (DE)

( * ) Notice: Subject to any disclaimer, the term of this patent is extended or adjusted under 35 U.S.C. 154(b) by 121 days.

(21) Appl. No.: 10/801,349

(22) Filed: Mar. 16, 2004

(65) Prior Publication Data

US 2004/0202005 A1 Oct. 14, 2004

(30) Foreign Application Priority Data

Mar. 17, 2003 (DE) ..... 103 11 853

(51) Int. Cl.
*F21V 29/00* (2006.01)

(52) U.S. Cl. ..... 362/294; 362/545; 362/800

(58) Field of Classification Search ..... 362/96, 362/294, 345, 373, 545, 547, 800
See application file for complete search history.

(56) References Cited

U.S. PATENT DOCUMENTS

| | | | | |
|---|---|---|---|---|
| 1,950,918 | A * | 3/1934 | Forbes | 362/547 |
| 5,174,646 | A * | 12/1992 | Siminovitch et al. | 362/373 |
| 5,785,418 | A | 7/1998 | Hochstein | |
| 6,045,240 | A | 4/2000 | Hochstein | |
| 6,367,949 | B1 | 4/2002 | Pederson | |
| 6,441,943 | B1 | 8/2002 | Roberts et al. | |
| 6,467,940 | B2 | 10/2002 | Eschler | |
| 6,682,211 | B2 * | 1/2004 | English et al. | 362/545 |
| 2002/0008976 | A1 | 1/2002 | Gronemeier et al. | |
| 2003/0174053 | A1 | 9/2003 | Rennick | |
| 2004/0022051 | A1 | 2/2004 | Weidel | |
| 2004/0105276 | A1 * | 6/2004 | Holz et al. | 362/547 |

FOREIGN PATENT DOCUMENTS

| | | |
|---|---|---|
| DE | 43 35 244 A1 | 6/1995 |
| DE | 100 27 018 A1 | 12/2001 |
| DE | 100 47 207 A1 | 4/2002 |
| DE | 100 55 462 A1 | 5/2002 |

* cited by examiner

*Primary Examiner*—Y. My Quach-Lee
(74) *Attorney, Agent, or Firm*—Akerman Senterfitt; Stephan A. Pendorf; Yonghong Chen

(57) ABSTRACT

The invention relates to a headlight 1 in particular based on the projection principle. The headlight has a semiconductor light source 4, which is arranged at the focal point of the reflector 2 and is connected to a cooling element 5. This cooling element 5 extends from the semiconductor light source 4 to the transparent lens 3, through which the light that is reflected by the reflector 2 is emitted, passes through the transparent lens 3, and projects beyond it. This arrangement of a semiconductor light source 4, a cooling element 5 and a transparent lens 3 ensures that the light source 4 is cooled effectively. In addition, the arrangement and the form of the cooling element 5 ensure that the cooling element 5 does not shadow, or only slightly shadows, the reflected light. This leads to a high light yield from the headlight 1 according to the invention, and to a long life.

16 Claims, 3 Drawing Sheets

HEADLIGHT FOR A VEHICLE

BACKGROUND OF THE INVENTION

1. Field of Invention

The invention relates to a headlight for a vehicle, in particular based on the projection principle, having a reflector, a light source at the focal point of the reflector, and a transparent lens. Headlights such as these are known from German Patent Application DE 100 47 207 A1 and from DE 100 27 018 A1. A halogen light source is arranged at the focal point of the reflector and emits both visible light and infrared radiation. In this case, the halogen light source is mounted in the reflector from the rear in a central recess. It emits the light either directly or indirectly via reflection on the reflector in the direction of the transparent lens.

2. Related Art of the Invention

German Patent Applications DE 43 35 244 A1 and DE 100 55 462 A1 disclose vehicle headlights which use semiconductor light sources. These are not based on the projection principle, and do not have a reflector at whose focal point the semiconductor light source is arranged.

SUMMARY OF THE INVENTION

The invention is based on the object of specifying a headlight which produces a good light yield and has a long life.

This object is achieved by a headlight having the features of Claim 1.

Advantageous developments of the headlight are the subject matter of the dependent claims.

The invention relates to a headlight for a vehicle according to the precharacterizing clause of Patent claim 1, in which a semiconductor light source is arranged as a light source at the focal point of the reflector and exclusively or essentially emits infrared spectrum radiation. Furthermore, the headlight is provided with a cooling element, which is thermally connected to the semiconductor light source, extends from the semiconductor light source to the transparent lens, and either projects into the lens or even passes through it.

This particular arrangement and configuration of the light source with a cooling element ensures the efficient dissipation of the heat which is generated in the production of the light by the semiconductor light source, away from the light source. The cooling element dissipates the heat from the light source firstly by itself having a considerable thermal capacity as a cooling element and thus leading to cooling of the light source, which is ensured by thermal coupling. This heat is then emitted to the atmosphere surrounding the cooling element, either only in the interior of the headlight or else in the vicinity of the headlight.

The fact that the cooling element optionally passes through the transparent lens ensures that the wind of motion and the area around the headlight lead to a reduction in the temperature of the cooling element, and thus of the semiconductor light source. This is achieved by emitting heat from the cooling element in the area in front of the transparent lens to the environment. This is normally the case during operation of the headlight, since the area surrounding the headlight is at a considerably lower temperature than the semiconductor light source. Cooling of the semiconductor light source is of particular importance for the functionality of the semiconductor light source, since, in contrast to a classical halogen light source, this must not be heated above a critical temperature, which is generally in the region of 120° C. or less. If this critical temperature is exceeded for a lengthy time or considerably, then this leads to destruction of the semiconductor light source, and thus to failure of the headlight for a vehicle. The arrangement of the cooling element or of the semiconductor light source in the headlight according to the invention ensures that the semiconductor light source of the headlight can be kept in a safe temperature state. In this case, semiconductor laser elements as well as LEDs, which may be in the form of individual light sources or in the form of an array, have been particularly proven for use as semiconductor light sources.

The arrangement of the semiconductor light source according to the invention means that there is no need for any large holes or recesses in the reflector for arrangement or incorporation of halogen light sources in the reflector, and this means that the reflector is entirely or largely available for reflection of the light which is emitted by the light source. These reflection characteristics are actually of particular importance in the area in which the centre axis of the at least essentially rotationally symmetrical reflector passes through the reflector. The configuration of the headlight according to the invention makes it possible to enlarge the reflective area, and thus to significantly improve the light yield of the headlight.

Furthermore, the light yield is also increased by the use of a semiconductor light source as the light source instead of a halogen light source or an incandescent light source, allowing the light to be emitted, for example in the form of radiation, efficiently and with extremely high light intensity. The provision of the cooling element ensures that the semiconductor light source does not just briefly represent a highly effective light source for the headlight according to the invention, but that this characteristic is also provided over a lengthy time period.

It has been found to be particularly advantageous for the position of the cooling element and hence also the position of the light source to be defined by the cooling element projecting into or passing through the lens, thus making it possible to dispense entirely or partially with additional or complex holders for fixing the position of the light source in the area of the focal point. The provision of simple additional holders, in contrast to complex disturbing holders, for the light source may be sufficient or excessive by virtue of the configuration of the cooling element according to the invention. It is thus possible to produce a simple and low-cost headlight.

It has been found to be particularly advantageous to choose semiconductor light-emitting diodes which emit infrared radiation (IR-LEDs), which emit radiation exclusively in the invisible band of electromagnetic radiation, that is to say in the infrared radiation band and not in the visible light band, so that, in consequence, they are particularly suitable for use in conjunction with a night-vision appliance or in an arrangement for improving vision with active infrared illumination, with a camera for recording the area illuminated by infrared radiation, and with a display for displaying the infrared image data which is recorded by the camera. An arrangement such as this with an infrared radiation headlight according to the invention such as this allows very reliable and long-term illumination of the surrounding area by means of infrared radiation, and thus allows data from the surrounding area to be recorded by the camera in a manner which allows it to be reproduced with considerable information. The headlight according to the invention allows early and continuous identification even in difficult circumstances, in particular at night or in fog.

According to one preferred embodiment of the invention, the cooling element extends along the centre axis of the reflector. This embodiment of the cooling element ensures that the cooling element does not significantly additionally shadow the emitted light. This is achieved in that, by virtue of its arrangement, the cooling element is located in the area of the centre axis, which forms the axis of rotational symmetry of the at least essentially rotationally symmetrical reflector, and thus is located entirely or essentially in the shadow of the semiconductor light source. The semiconductor light source, which is located at the focal point and thus on the centre axis, emits its, in particular infrared, radiation in the direction of the reflector which, by virtue of its configuration as a reflector for a headlight, deflects the reflected radiation such that it is emitted at least essentially parallel to the centre axis. This results in the small amount of shadowing, as stated, by the cooling element being formed along the centre axis. This small amount of, or non-existent, additional shadowing is particularly small when, as in the case of one particularly preferred embodiment of the invention, the cooling element is in the form of a rod, in particular with a constant diameter. This on the one hand ensures a very small amount of shadowing and on the other hand low-cost production with good heat dissipation as a result of the solid configuration of the cooling element in the form of a rod. This leads to a particularly long-life and effective embodiment of a headlight.

According to another preferred embodiment of the invention, the cooling element has one or more essentially flat elements which are arranged in particular running radially in the reflector. These essentially flat elements may be formed independently of a cooling element, which in particular is in the form of a rod and extends along the centre axis. The flat configuration of the cooling element, or of a part of the cooling element, results in particularly effective heat emission to the area surrounding the cooling element. This surrounding area may on the one hand be the interior of the reflector, but on the other hand may also be the area around the headlight, in particular the area on the side of the transparent lens facing away from the light source. This flat configuration ensures that the cooling element can dissipate heat from the semiconductor light element very effectively, and can thus transport it away, which means that it is possible to prevent overheating of the semiconductor light element. This means that the life and the light yield of the semiconductor element are ensured to a particular degree. Furthermore, the arrangement of the flat element running radially from the centre axis, in particular, ensures that it is possible to prevent undesirable significant shadowing by the cooling element. Since the cooling element has two or more flat elements which, in particular, are connected to a part of the cooling element which is in the form of a rod and extends along the centre axis, the cooling element is compact, mechanically stiff and can bear loads, while being thermally connected to the semiconductor light source and, by virtue of this connection, being suitable for holding the semiconductor light source completely or additionally mechanically in the area of the focal point of the reflector. This embodiment of the cooling element means that complex additional holders for the light source, in order to fix its position in the area of the focal point, can be dispensed with entirely or essentially. This leads to a simple headlight, which, furthermore, is particularly efficient, especially as a result of a reduction in the shadowing elements.

A particularly advantageous embodiment of the cooling element with two or more radially running flat elements is created by these two or more flat elements being arranged rotationally symmetrically about the centre axis. In this case, it has been found to be particularly useful to provide three, four or five flat elements, arranged in the form of a star. This rotationally symmetrical configuration, in particular in the form of a star, results in a mechanically very stiff and robust arrangement of the flat elements in order to provide secure fixing of the semiconductor light source in the area of the focal point, which in particular has the advantage that the cooling element is fixed very effectively in the lens.

The flat elements may in this case have a standard, essentially constant, material thickness over their area, which leads to a very low-cost embodiment of the cooling element. However, they may also be formed with a variable material thickness, that is to say the material thickness may increase as the distance from the centre axis increases, or else may decrease, or may increase or decrease in areas. Depending on the specific choice of material or on the desired mechanical effect, the most suitable embodiment of the flat elements is chosen to be that with a constant or different material thickness. In particular, it has been found to be useful in this case for areas which are particularly susceptible to vibration to have a greater material thickness, thus ensuring the resistance and long life of the headlight.

It has been found to be particularly advantageous for the cooling element which, in particular, is partly in the form of a rod and/or is flat, to being completely mirrored, or to be mirrored in major parts, which means that the cooling element which is arranged in the beam path of the headlight does not result in any significant absorption of the infrared radiation or of the visible light, thus leading to a headlight embodiment which is highly effective and has a high light intensity. The light components which are reflected by mirroring are, according to the invention, normally only relatively minor since the cooling element, according to the invention, extends parallel to or along the centre axis and thus along the light propagation direction of the light which is reflected by the reflector. This mirrored configuration makes it possible to compensate for manufacturing tolerances in a particularly acceptable manner, and to prevent discrepancies from the ideal configuration or arrangement of the cooling element, or of the light source in the headlight with the reflector, from leading to any significant adverse effect on the light yield.

In particular, it has been found to be useful to use a particularly thermally conductive material, in particular composed of metal, for the cooling element. Aluminium, copper, silver and iron or an alloy of these elements have been found to be particularly useful for this purpose. These metals can be machined particularly well, can transport heat well and, in some cases, also have a high thermal capacity. On the one hand, these metallic cooling elements are distinguished by rapid, effective dissipation of the heat from the semiconductor light source, due in particular to the high thermal capacity, and on the other hand they are distinguished by the good heat transport characteristics and thus the capability to emit the heat in particular to the area around the headlight.

Furthermore, it has also been found to be particularly useful for the cooling element, in particular a cooling element in the form of a rod, to be in the form of a metallic sleeve around an internal area, with the internal area being filled by the metal sodium while, in contrast, the sleeve is formed in particular from aluminium, copper, silver and iron, or an alloy of these metals. This structured configuration results in a cooling element which is highly thermally conductive and is mechanically robust.

It has been found to be particularly useful for the cooling element which passes through the lens to be sealed from the lens by an elastic, in particular permanently elastic, sealing agent. This elastic sealing agent ensures that stresses which occur as a result of the typically different thermal coefficients of expansion of the material of the lens and of the cooling element do not lead to damage to the lens or to the cooling element, or to splitting and thus to the formation of a gap between the two components. This results in a reliable and long-life implementation of the headlight which allows reliable operation even in extreme thermal or other weather conditions. The use of silicone rubber as the permanently elastic sealing agent has been found to be particularly useful in this context.

Furthermore, it has advantageously been found to be particularly useful for the cooling element not to be the same colour as the reflector, as is possible as a result of the special design of the headlight with the cooling element according to the invention. On the one hand, this makes it possible to produce a highly effective headlight which, furthermore, can also be designed to be particularly aesthetic and appealing.

According to one preferred embodiment of the invention, the cooling element projects only insignificantly beyond the lens, or ends flush with the lens. This ensures that, while providing an adequate cooling area in the region of the side of the transparent lens which faces away from the semiconductor light source, there is no danger to passers-by as a result of projecting parts of the headlight in the event of an impact with the vehicle having the headlight according to the invention. In this case, it has been found to be particularly useful for the edge area of that part of the cooling element which project beyond the lens to merge smoothly into the lens, and thus to provide a flat transition, without any discontinuity, from the cooling element to the lens. This ensures that it is largely impossible for a passer-by or any other object to become snagged. Furthermore, this also ensures that the lens is prevented from becoming very dirty, and this aim is also assisted by the lens together with the cooling element having a particularly advantageous aerodynamic shape, which can be integrated in a particularly attractive manner into the shape of the overall vehicle.

It has been found to be particularly advantageous to arrange a heat sink, in particular in the form of a disc, on that side of the lens which faces away from the semiconductor light source, and to connect this heat sink thermally and mechanically to the cooling element. This ensures that the cooling area which is in contact with the area around the headlight is enlarged, thus increasing the cooling effect of the cooling element with the heat sink for the semiconductor light source to a particular extent. In this case, the heat sink which, in particular, is in the form of disc, preferably tapers in its edge area so that it merges smoothly into the lens.

It has been found to be particularly useful for the semiconductor light source to be in the form of an array comprising two or more individual light sources which are jointly arranged on a mount which has sufficient thermal conductivity and which is thermally connected to the cooling element. This embodiment of the semiconductor light source as an array with a mount ensures that this creates a compact light source whose light intensity is high and which can be produced at low cost, ensures temperature equalization via the mount, and allows reliable and effective dissipation of the heat via the thermally connected cooling element. This arrangement results in a particularly effective vehicle headlight with high light intensity, which ensures thermal coupling to the cooling element over a large area even if the mount is flat, and thus allows the semiconductor light source to have a low operating temperature, and hence high efficiency, as well as allowing the semiconductor light source to have a long life. In this case, the array is preferably arranged completely on one side of the flat mount and emits its, in particular infrared, radiation in the direction of the reflector, which reflects the, in particular infrared, radiation and then emits it parallel to the centre axis, and thus along the cooling element. The arrangement of individual light sources or a considerable proportion of the individual light sources of one side of the flat mount, and the arrangement and/or thermal coupling of the cooling element on or to the other side of the flat mount provide physical isolation and thus also functional isolation between the various components of the headlight, which leads to the headlight having a long life and a high light intensity.

Furthermore, it has been found to be particularly useful for the flat elements of the cooling element not just to be mechanically connected to the transparent lens such that they pass through it or just to project into the lens, and hence to fix their position in the interior of the reflector, but to mechanically connect one or more flat elements to the reflector, thus mounting the cooling element in a manner which is even more secure. This also results in a corresponding manner in the semiconductor light source being held in an appropriately secure and defined position and being thermally connected to the cooling element, which is normally connected to a defined, fixed arrangement (which is therefore not physically variable) between the cooling element and the semiconductor light source. This means that there is no need for any additional holders for the semiconductor light source other than the cooling element. This particular embodiment of the fixing of the position of the cooling element on the one hand with respect to the transparent lens and on the other hand with respect to the reflector ensures that there is normally no need to be concerned about the position of the cooling element, and hence of the light source being unstable even in poor conditions, in particular in the event of severe vibration. This ensures that the light source is located with adequate security in the area of the focal point of the reflector, and remains in this area. This results in a particularly reliable and long-life implementation of the headlight, which remains functional even in extreme conditions.

Furthermore, it has been found to be particularly useful for the power supply for the semiconductor light sources to be provided via the cooling element. On the one hand, this can be achieved by arranging conductor tracks adjacent to, on or in the cooling element and, on the other hand, it is also possible for the individual parts of the cooling element to be electrically conductive and to be isolated from one another, and for these electrically conductive parts which are isolated from one another to be used as electrically conductive lines for supplying power to the light source. This use of the cooling element for supplying power to the light source makes it possible to provide the central area of the reflector, that is to say the trough-like area of the reflector, with a closed reflective surface, without adversely affecting its operation by electrical supply lines or connections. This embodiment makes it possible to provide a highly effective headlight.

BRIEF DESCRIPTION OF THE DRAWINGS

The invention will be explained in more detail in the following text with reference to two exemplary embodiments.

DETAILED DESCRIPTION OF THE INVENTION

Figure 1:
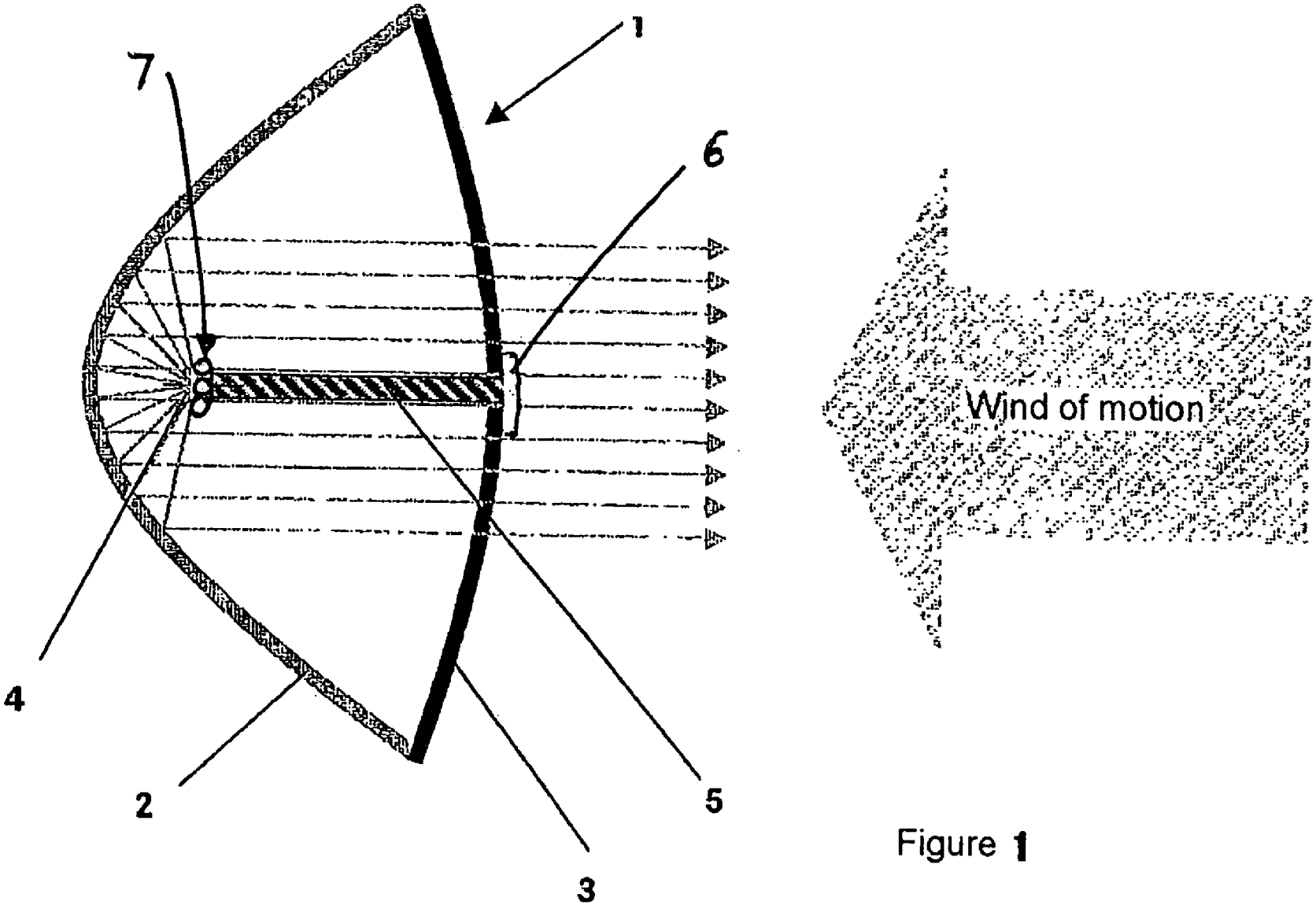
FIG. 1 shows a longitudinal section through a first exemplary embodiment of the headlight according to the invention.

FIG. 1 shows a headlight 1 which has a reflector 2 and a transparent lens 3. The reflector 2 is designed such that a semiconductor light source 4 which is arranged at its focal point reflects the emitted radiation, when infrared radiation is emitted in the direction of the reflector 2, such that the reflected radiation is emitted through the transparent lens as an essentially parallel beam. This headlight 1 operates as a vehicle headlight.

The semiconductor light source 4 is a semiconductor light-emitting diode which emits infrared radiation and is mechanically and thermally connected to a cooling element 5. The cooling element 5 is in the form of a rod with a constant diameter, and extends from the light source 4 along the centre axis of the rotationally symmetrical reflector 2 as far as the transparent lens 3, and through it. The cooling element 5 thus even extends further into the area around the headlight 1.

The cooling element 5, which is in the form of a rod, has essentially the same cross section as the semiconductor light source 4. This means that the cooling element 5, which is in the form of a rod, is essentially located in the shadow of the semiconductor light source 4. This ensures that the radiation which is reflected by the reflector 2 and propagates essentially parallel to the centre axis of the reflector 2, and thus along the cooling element 5 which is in the form of a rod, is not impeded, or is impeded only to a minor extent, by the cooling element 5. This ensures that there is no additional shadowing, or only a small amount of additional shadowing, by the cooling element 5, thus resulting in a very highly efficient headlight 1.

The attachment element 5, which is in the form of a rod, is fixed in the transparent lens 3, which means that its position is fixed in the reflector 2 and hence in the headlight 1, and this thus also means that the position of the semiconductor light source 4, which is firmly connected to the cooling element 5 both mechanically and thermally, is fixed. The configuration according to the invention as described in FIG. 1 means that there is no need for any additional attachment elements for the light source 4.

The cooling element 5 is formed from copper coated with a chromium layer. The chromium plating results in a minored surface which particularly well prevents undesirable absorption of the reflected light and thus largely reduces any possible adverse affect on the light yield resulting from the cooling element. The use of copper ensures that the heat which is produced by the semiconductor light source 4 during operation is transferred very quickly and efficiently to the cooling element 5, is passed through the transparent lens, and is emitted to the surrounding area. The fact that the cooling element 5 passes through the transparent lens 3 and projects beyond the lens 3 ensures that the wind of motion to which the headlight according to the invention is subject during operation of the vehicle leads to significant cooling of that part of the cooling element 5 which projects beyond the lens 3, thus ensuring that the heat from the light source 4 is dissipated via the cooling element 5, which is in the form of a rod, and is emitted to the surrounding area. This ensures that the light source 4 is kept in a temperature range which leads to no significant damage to the light source 4. It is thus largely possible to prevent overheating of the semiconductor light source 4, for example by reaching a temperature of 150° C., and this on the one hand has a highly positive effect on the efficiency of the semiconductor light source 4 while, on the other hand, it influences the life of the semiconductor light source 4. Optionally, a flat heat sink 6, in particular in the form of a disc, can be arranged on the side of the lens 3 which faces away from the light source 4 and is thermally connected to the cooling element 5. Also, the light source may represent an array 7 including two or more individual light sources, which is arranged on a mount and whose mount is thermally conductively connected to the cooling element.

In summary, it can be stated that the embodiment of the invention as illustrated in FIG. 1 is distinguished by good heat dissipation and thus by high efficiency of the light source 4, with a longer life. Furthermore, the described embodiment has a very high light yield which is due in particular to the fact that the mirror surface of the reflector 2 has no significant interruptions, in particular in the central area of the reflector, which is the area that is closest to the semiconductor light source 4, and the fact that the embodiment and arrangement of the cooling element 5 do not result in any additional shadowing, or only a very small amount of additional shadowing, of the reflected radiation.

Figure 2:
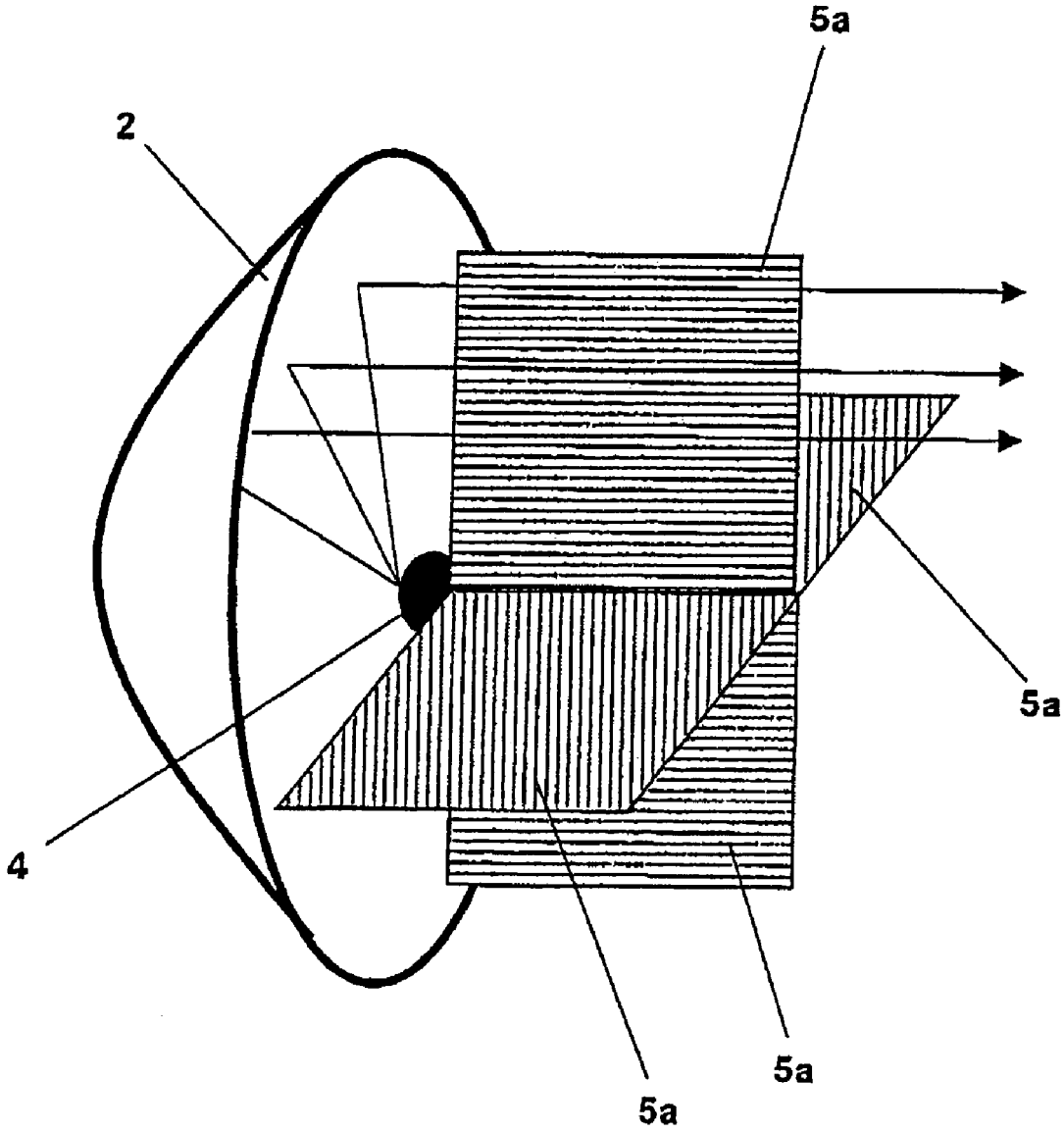
FIG. 2 shows a schematic illustration of another embodiment of a headlight according to the invention.

FIG. 2 shows another embodiment of the headlight according to the invention. The following text will describe only the significant differences in comparison to the embodiment of the headlight according to the invention as shown in FIG. 1. In order to avoid repetition, corresponding or identical embodiments of individual components of the headlight will not be described.

The reflector 2, which is not shown completely, is in the form of a paraboloid or a hyperboloid at whose focal point the IR semiconductor light source 4 is arranged. The IR semiconductor light source 4 is connected to the cooling element, which is formed from four flat surfaces 5*a*. The four flat surfaces 5*a* are in the form of rectangular plates, which are arranged such that they run radially around the centre axis, which is the axis of rotational symmetry of the reflector 2. In this case, the four flat plates 5*a* of the cooling element are arranged in a star shape and rotationally symmetrically about the centre axis. They are thus aligned such that the radiation which is reflected by the reflector 2 runs parallel to the flat elements 5*a*. The light source 4 is arranged in the area of one corner of the individual flat elements 5*a*, which each abut against one another at this corner and are firmly connected to one another, both mechanically and thermally. This thermal and fixed mechanical connection ensures that the heat from the light source is dissipated to the flat elements 5*a*, and that the heat is then emitted to the area surrounding the flat elements 5*a*, on the one hand within the reflector 2 and on the other hand outside the headlight. The flat configuration ensures this to a particular extent. This heat transfer ensures that the light source 4 is not overheated. The flat elements 5*a*, which are in the form of plates, are made from thin material, so that there is very little shadowing. Furthermore, the surfaces are mirrored, thus allowing the infrared radiation to be absorbed only to a very restricted extent. The mirroring is chosen such that it is not the same colour as the mirroring of the reflector. This also makes it possible to produce optics which are particularly appealing, in addition to the particular light yield of the headlight according to the invention.

The star-shaped configuration of the cooling element that is composed of the four flat elements 5*a* which pass through the lens, which is not illustrated in FIG. 2, ensures that the position of the cooling element with respect to the light source 4 that is attached to it is fixed securely, so that there is no need to provide any additional holding or attachment elements for the light source 4.

Of the four flat elements 5*a,* two are isolated from one another and are designed such that they are electrically isolated as well as being electrically conductive. These two flat elements 5*a* are used to supply the electrical power for the light source 4. There is thus no need to provide additional electrical supply lines, thus preventing further shadowing by additional electrical supply lines. This leads to a headlight with very high light intensity.

Figure 3:
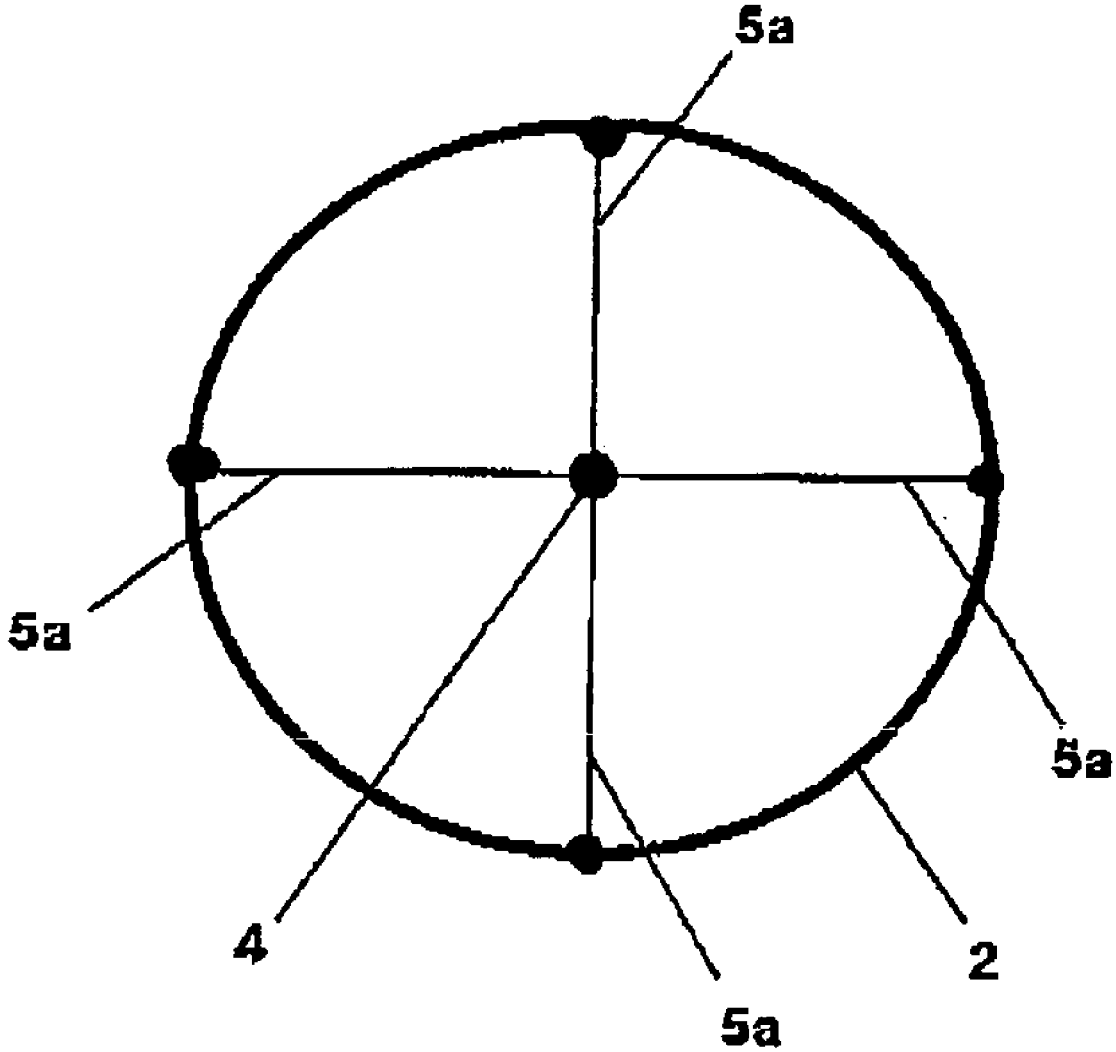
FIG. 3 shows a view of the example of a headlight according to the invention, as in FIG. 2, from the front.

FIG. 3 shows the view of the lens 3 from the front. Four planar flat elements 5*a* pass through the lens 3, and together-form the cooling element. The four flat elements 5*a* are arranged rotationally symmetrically in a star shape about the centre axis of the headlight, or of the reflector 2. The flat elements 5*a* are thermally and mechanically connected to the light source 4 in the centre. A coupling is provided at the other radially remote end of the flat elements 5*a,* in which the flat elements 5*a* are firmly connected to the surrounding reflector 2. This mechanical coupling fixes the position and orientation of the flat elements 5*a* with respect to the cooling element and the light source 4. This fixed orientation is maintained even in severe boundary conditions, in particular in the event of shaking, vibration and the like.

The invention claimed is:

1. A headlight for a vehicle, having a reflector having a focal point and a center axis, a semiconductor light source in the area of the focal point of the reflector, a transparent lens, and a metal cooling element, wherein the cooling element firmly connected to the light source both mechanically and thermally, extends from the light source to the lens and is fixed in the lens by projecting into or passing through the lens.

2. The headlight according to claim 1, wherein the cooling element extends along the center axis of the reflector.

3. The headlight according to claim 1, wherein the cooling element has an element in the form of a rod.

4. The headlight according to claim 1, wherein the cooling element has one or more essentially flat elements.

5. The headlight according to claim 4, wherein the one or more flat elements are arranged running radially from the center axis.

6. The headlight according to claim 5, wherein two or more radially running flat elements are provided, and are arranged rotationally symmetrically about the center axis.

7. The headlight according to claim 5, wherein 3, 4 or 5 radially running flat elements are provided and are arranged in the form of a star.

8. The headlight according to claim 4, wherein the two or more flat elements are mechanically connected to the reflector.

9. The headlight according to claim 1, wherein the cooling element is partially or completely mirrored.

10. The headlight according to claim 1, wherein the cooling element is composed of aluminum, copper, silver, iron, or an alloy using such metals.

11. The headlight according to claim 1, wherein the cooling element is not the same color as the reflector.

12. The headlight according to claim 1, wherein the cooling element substantially does not project beyond the lens.

13. The headlight according to claim 12, wherein a flat heat sink is arranged on the side of the lens which faces away from the light source and is thermally connected to the cooling element.

14. The headlight according to claim 1, wherein the light source represents an array comprising two or more individual light sources, which is arranged on a mount thermally conductively connected to the cooling element.

15. A headlight for a vehicle, having a reflector having a focal point, a light source in the area of the focal point of the reflector, and a transparent lens, wherein the light source is a semiconductor light source which emits infrared radiation, and wherein a cooling element is provided which is thermally connected to the light source, extends from the light source to the lens and projects into the lens or passes through it, wherein the cooling element is sealed from the lens by means of an elastic sealing agent.

16. A headlight for a vehicle, having a reflector having a focal point, a light source in the area of the focal point of the reflector, and a transparent lens, wherein the light source is a semiconductor light source which emits infrared radiation, and wherein a cooling element is provided which is thermally connected to the light source, extends from the light source to the lens and projects into the lens or passes through it, wherein the power supply for the light source is provided via the cooling element.

* * * * *